US008387294B2

(12) United States Patent
Bolden

(10) Patent No.: US 8,387,294 B2
(45) Date of Patent: Mar. 5, 2013

(54) HANDGUN IDENTIFICATION LIGHT

(76) Inventor: Eric L. Bolden, Far Rockaway, NY (US)

( * ) Notice: Subject to any disclaimer, the term of this patent is extended or adjusted under 35 U.S.C. 154(b) by 0 days.

(21) Appl. No.: 12/950,858

(22) Filed: Nov. 19, 2010

(65) Prior Publication Data

US 2011/0138667 A1 Jun. 16, 2011

Related U.S. Application Data

(60) Provisional application No. 61/282,088, filed on Dec. 14, 2009.

(51) Int. Cl.
*F41C 27/00* (2006.01)

(52) U.S. Cl. ..... 42/1.01; 42/84; 42/85

(58) Field of Classification Search ..... 42/1.01, 42/84, 85, 106, 70.01; 362/110
See application file for complete search history.

(56) References Cited

U.S. PATENT DOCUMENTS

| | | | | |
|---|---|---|---|---|
| 5,044,107 | A * | 9/1991 | Holford | 42/132 |
| 5,194,007 | A * | 3/1993 | Marshall et al. | 434/21 |
| 5,448,847 | A * | 9/1995 | Teetzel | 42/70.11 |
| 5,481,819 | A * | 1/1996 | Teetzel | 42/117 |
| 5,560,703 | A * | 10/1996 | Capps, III | 362/110 |
| 5,822,905 | A | 10/1998 | Teetzel | |
| 6,230,431 | B1 * | 5/2001 | Bear | 42/117 |
| 6,678,984 | B1 * | 1/2004 | Rapp et al. | 42/70.11 |
| 6,775,940 | B2 * | 8/2004 | Dworzan et al. | 42/1.01 |
| 6,892,488 | B1 * | 5/2005 | Serravalle | 42/113 |
| 7,260,910 | B2 * | 8/2007 | Danielson | 42/117 |
| 7,308,202 | B2 * | 12/2007 | Roes et al. | 398/108 |
| 7,360,332 | B2 * | 4/2008 | Rozovsky | 42/70.07 |
| 7,509,766 | B2 * | 3/2009 | Vasquez | 42/1.01 |
| D616,957 | S * | 6/2010 | Rievley et al. | D22/110 |
| 7,735,255 | B1 * | 6/2010 | Kincaid et al. | 42/146 |
| 7,805,876 | B1 * | 10/2010 | Danielson et al. | 42/114 |
| 7,845,817 | B1 * | 12/2010 | Miller | 362/110 |
| 7,866,083 | B2 * | 1/2011 | Teetzel | 42/146 |
| 7,954,971 | B1 * | 6/2011 | Kincaid et al. | 362/110 |
| 8,093,992 | B2 * | 1/2012 | Jancic et al. | 340/12.5 |
| 8,096,073 | B2 * | 1/2012 | Vielbig | 42/1.01 |
| 2004/0025392 | A1 * | 2/2004 | Dworzan et al. | 42/1.01 |
| 2007/0236384 | A1 * | 10/2007 | Ivtsenkov et al. | 342/45 |
| 2008/0016746 | A1 | 1/2008 | Mathis | |
| 2008/0060246 | A1 * | 3/2008 | Rozovsky | 42/70.01 |
| 2008/0134562 | A1 | 6/2008 | Teetzel | |
| 2009/0229160 | A1 * | 9/2009 | Elliott et al. | 42/73 |
| 2010/0031552 | A1 * | 2/2010 | Houde-Walter | 42/72 |
| 2010/0229448 | A1 * | 9/2010 | Houde-Walter et al. | 42/72 |
| 2011/0047851 | A1 * | 3/2011 | Mock et al. | 42/72 |
| 2011/0162251 | A1 * | 7/2011 | Houde-Walter | 42/146 |

* cited by examiner

*Primary Examiner* — Benjamin P Lee
(74) *Attorney, Agent, or Firm* — Richard C. Litman

(57) ABSTRACT

The handgun identification light is a device attachable to a handgun, the device illuminating the handgun with flashing blue and red lights to provide advanced real-time early warning to police officers who encounter a fellow off-duty plainclothes or undercover officer during their response to the commission of a crime. The device has an on-off switch connected to a battery and flashing LED's disposed along opposing sides of the device. The device includes a tilt switch, grip switch, or gun motion sensor that detects when a user draws the weapon. By activation of the flashing red and blue light device on his weapon, an off-duty plainclothes or undercover police officer who draws the weapon becomes readily identifiable by other officers in proximity as a fellow law officer, thus avoiding misidentification and tragically resultant friendly fire incidents.

11 Claims, 10 Drawing Sheets

HANDGUN IDENTIFICATION LIGHT

CROSS-REFERENCE TO RELATED APPLICATION

This application claims the benefit of U.S. Provisional Patent Application Ser. No. 61/282,088, filed Dec. 14, 2009.

BACKGROUND OF THE INVENTION

1. Field of the Invention

The present invention relates to accessories for handguns, and particularly to a handgun identification light that is attachable to a handgun.

2. Description of the Related Art

An old police tradition of requiring off-duty-plainclothes officers to carry their weapons "always armed, always on duty" is being scaled back in police departments nationwide following the shootings of off-duty officers by colleagues who thought they were criminals. The policies require officers to respond to crimes even when they are not on duty. Supporters say the tradition also protects officers from criminals bent on revenge.

Nevertheless, critics point to shootings of officers in a variety of jurisdictions as reasons for change. Many jurisdictions have found themselves the target of civil rights, wrongful death, and the like, lawsuits over friendly fire officer shootings. In today's technological society, the incidence of any friendly fire activity should not be tolerated and begs for a technological solution. Moreover, often times a suspect would comment that an undercover police officer never identified himself, the situation leading to the suspect being seriously injured or killed by officer's weapons fire. Officers would claim that their shields were properly displayed.

However, during pursuit of a suspect, the shield would be lost or dislodged under the officers' clothing, the officer not having noticed that he/she is not properly identified. When the officer catches up with the suspect there's no shield. Several officers are now yelling verbal commands to drop the weapon at different times. Their commands sound like chaotic noise from unidentified gun wielding persons, wherein the suspect may defensively assault officers, whereupon officers return fire with deadly consequences. The civilian community subsequently becomes upset with the officer(s), who now may have to stand trial for wrongful death or improper use of deadly force. The lawsuits may result in the jurisdiction having to pay out millions of dollars. A device is needed that would avoid the aforementioned situation.

Additionally, a device that allows a suspect to see the amount of law enforcement manpower surrounding him will act as a deterrent and possibly cause the suspect to more easily surrender to the LEDs.

Thus, a handgun identification light solving the aforementioned problems is desired.

SUMMARY OF THE INVENTION

The handgun identification light is a device attachable to a handgun, the device illuminating the handgun with flashing blue and red lights (having a color and flash pattern similar to the familiar police vehicle identifying lights) to provide advanced, real time early warning to police officers who encounter a fellow off-duty-plainclothes or undercover officer during their response to the commission of a crime. The device has an on-off switch connected to a battery and flashing LED's disposed along opposing sides of the device to provide high visibility from both left and right sides of the device.

The device includes a tilt switch, grip switch, or gun motion sensor that detects when a user draws the weapon. By activation of the flashing red and blue light device on his weapon, an off-duty plainclothes or undercover police officer who draws the weapon becomes readily identifiable by other officers in proximity as a fellow law officer, thus avoiding misidentification and tragically resultant friendly fire incidents.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
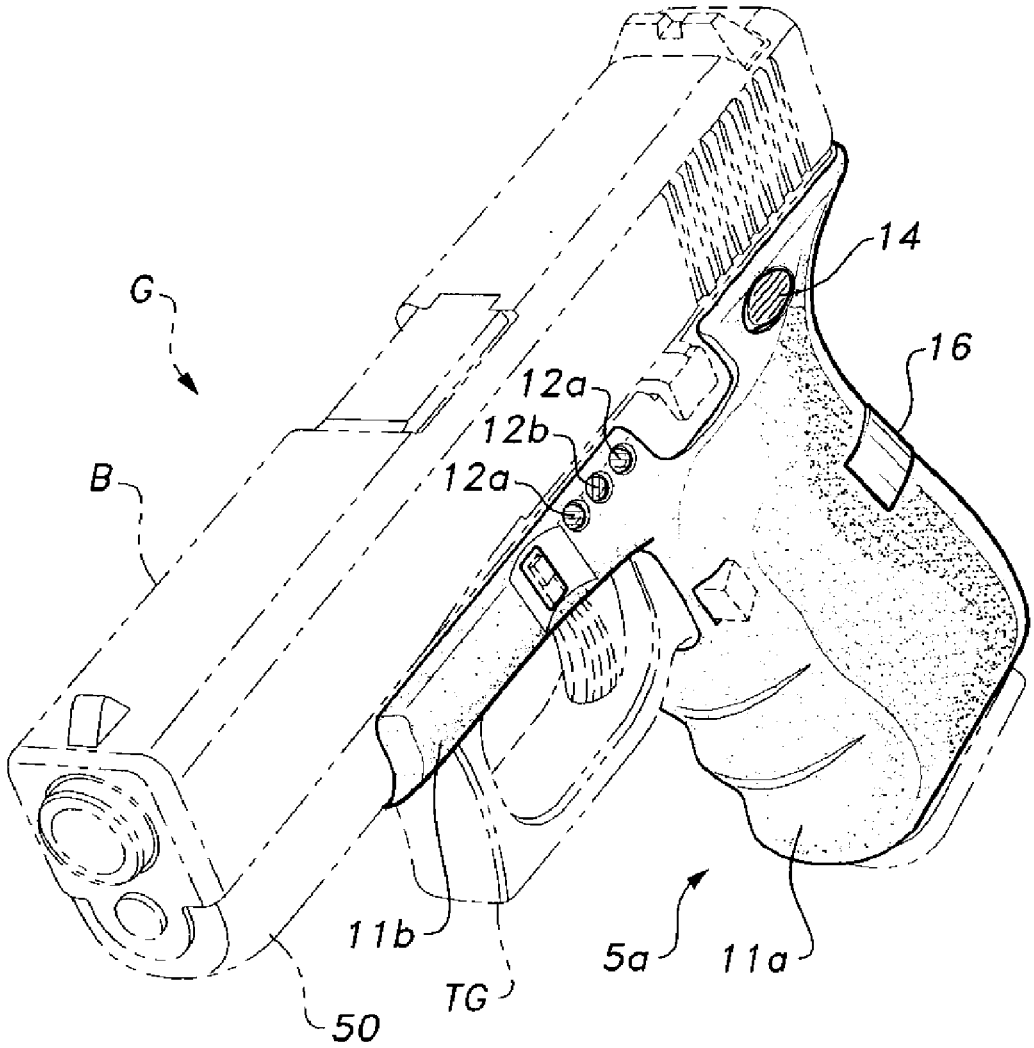
FIG. 1 is an environmental perspective view of a handgun equipped with a first embodiment of a handgun identification light according to the present invention, as seen from the left side of the gun.
Figure 2:
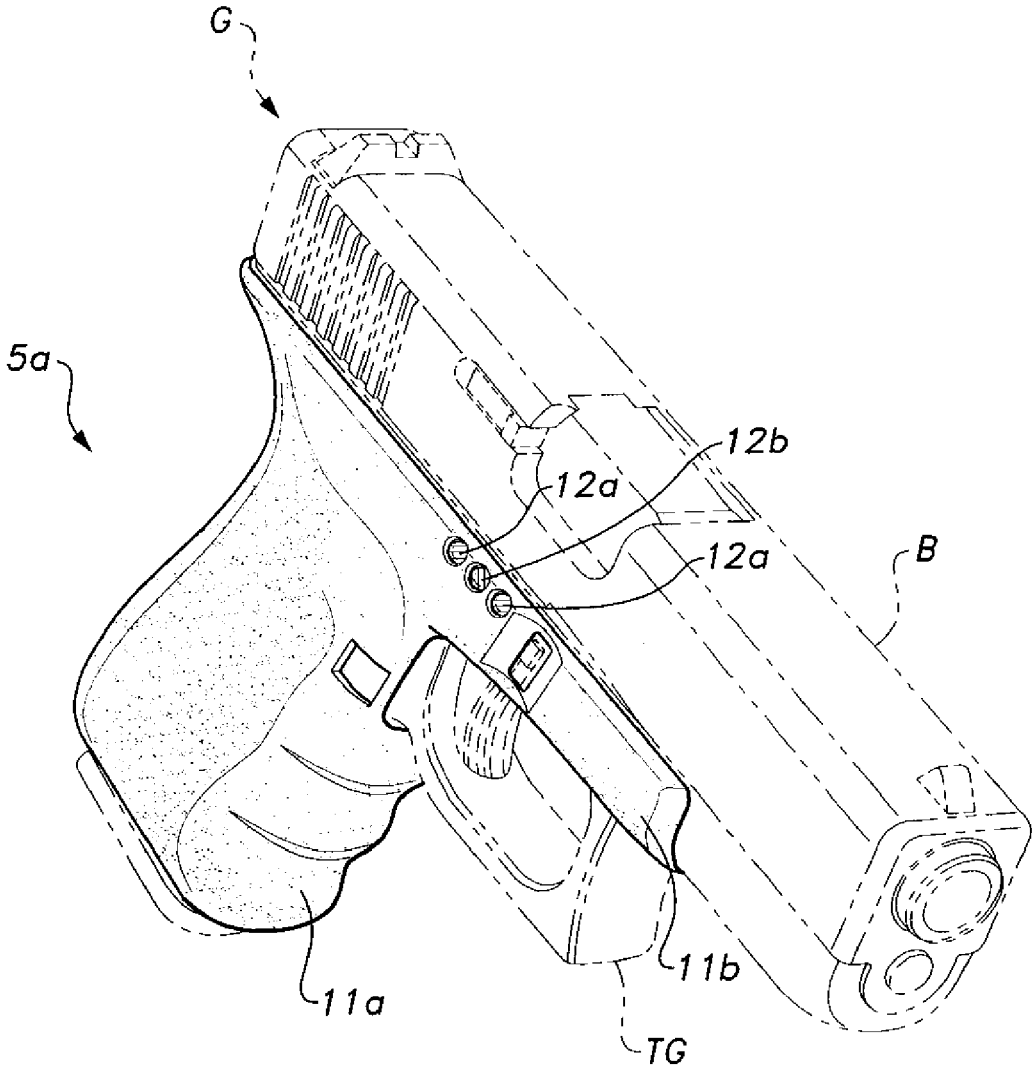
FIG. 2 is an environmental perspective view of the handgun identification light of FIG. 1 as seen from the right side of the gun.
Figure 3:
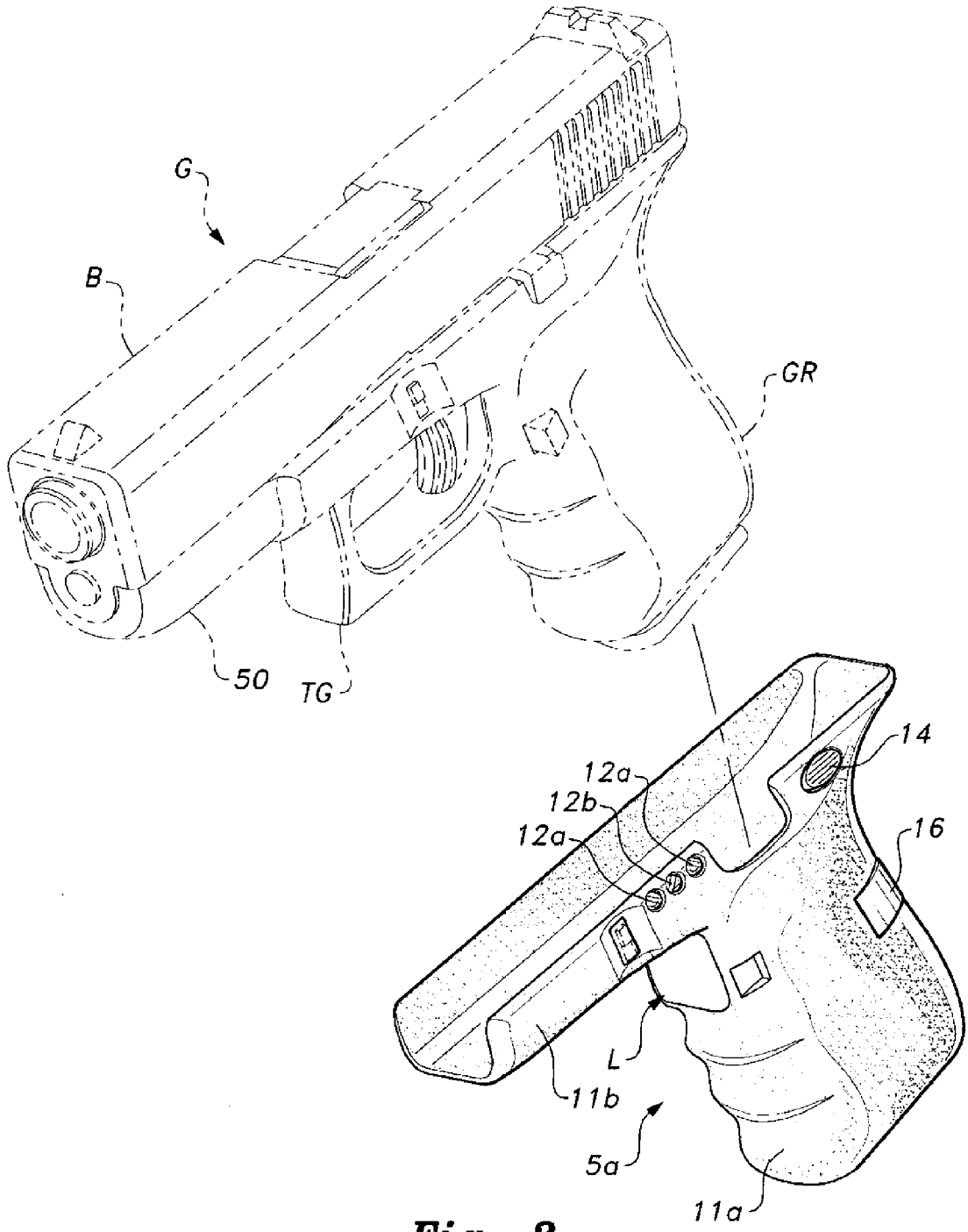
FIG. 3 is a perspective view of the handgun identification light of FIG. 1, shown with the handgun exploded from the handgun identification light.

FIGS. 1-3 show a first embodiment of a handgun identification light 5*a* that is intended to help keep law enforcement officers (LEDs) from shooting each other, and to give notice to suspects during an incident where it may not be clear who is who based on appearance and mode of dress. FIGS. 1-2 show the handgun identification light 5*a* attached to an automatic or semi-automatic pistol.

The handgun identification light 5*a* has a resilient, semi-rigid flexible grip sheath 11 a made from rubber that extends from a rear portion of a slotted, elongate, high impact-resistant, plastic member 11*b*, which is custom-fitted to the contour of the gun G's frame 50. When attaching the device 5*a*, the trigger guard TG of gun G can fit through the slot L of the co-joined plastic member 11*b* and grip sheath 11*a*. The elastic, flexible, open-ended grip sheath 11*a* snugly fits over the grip portion GR of handgun G, while still allowing access to load and remove a magazine from the bottom of the grip. The plastic member 11*b* forms a channel having sides that extend to just below the slide of the automatic, and extends from the rear of the grip to just beyond the trigger guard beneath the barrel B of the gun G. The channel of the plastic member 11*b* may form a snap fit or friction fit to the frame of the handgun G.

Red flashing LED lights 12*a* and a blue flashing LED light 12*b* are disposed along opposing sides of the plastic member 11*b* and are plainly visible from both sides of a gun equipped with the device 5*a*. The grip sheath 11*a* is open from its top portion to its bottom portion and snugly fits over the grip portion GR of the handgun G, while the slotted elongate member 11*b* snugly snaps into place around the frame 50 of gun body, extending under a portion of the barrel B of handgun G. The grip sheath 11*a* may be open at the bottom to permit removal of the magazine to reload the pistol without having to remove the handgun identification light 5*a*.

A battery power source BAT can be disposed inside of the grip sheath 11*a* and supply power to an electronic circuit 990 (shown in FIG. 10) having a cutoff switch 14, which is disposed on the upper rear portion of the grip sheath 11*a*. Circuit 990 including its microprocessor-memory combination 940, programming input P, actuation input S, LED driver 960, battery BAT, cutoff switch 14, actuator 921 and LED array 918 is exemplary. Such LED driver circuits are well known to those of ordinary skill in the art. The LED actuator 921 may comprise a light activation switch 16, which may be disposed on a medial rear portion of the grip sheath 11*a*. When the grip of the gun G is grabbed, pressure is applied to the light activation switch 16, which turns on LED light array 918 which may be comprised of LED lights 12*a* and 12*b*. The LED lights 12*a* and 12*b* preferably light up in a blinking or flashing pattern when activated.

Figure 4:
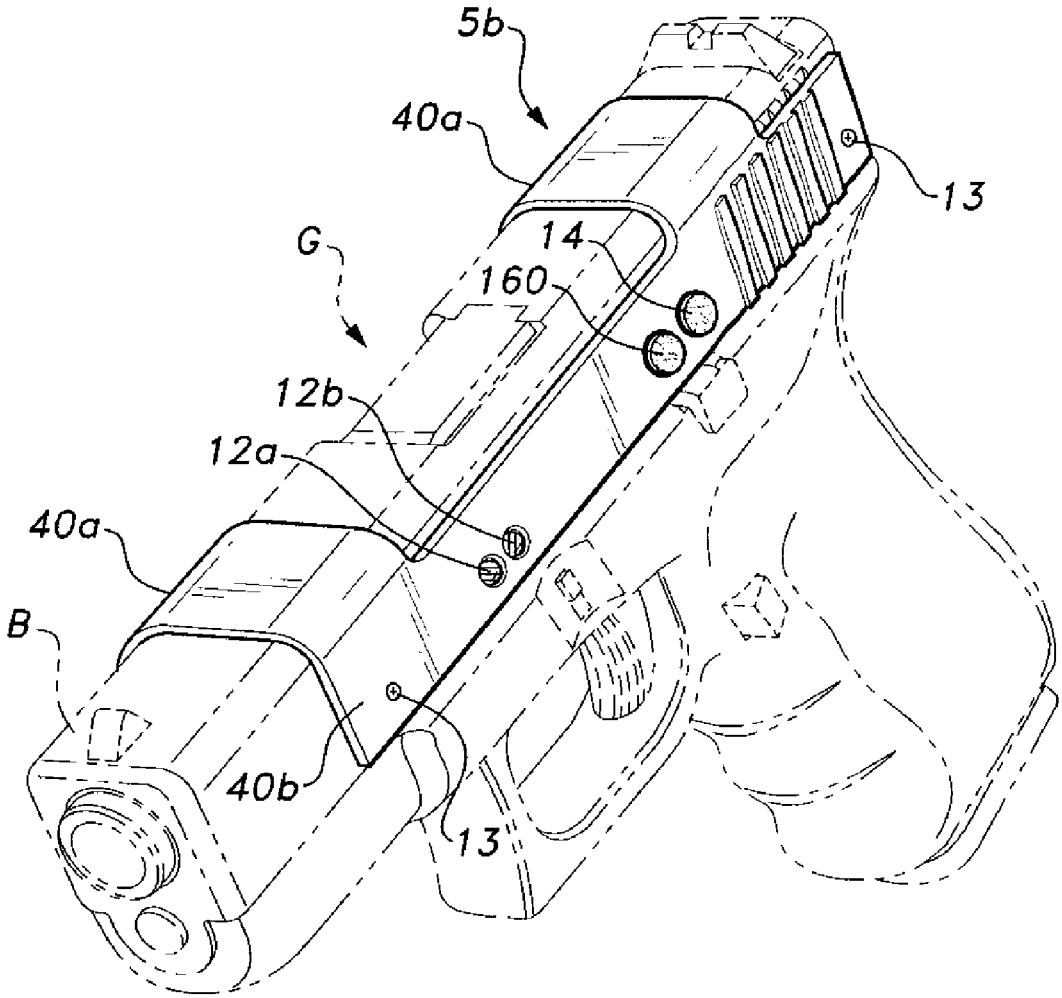
FIG. 4 is an environmental perspective view of a handgun equipped with a second embodiment of a handgun identification light according to the present invention, as seen from the left side of the gun.
Figure 5:
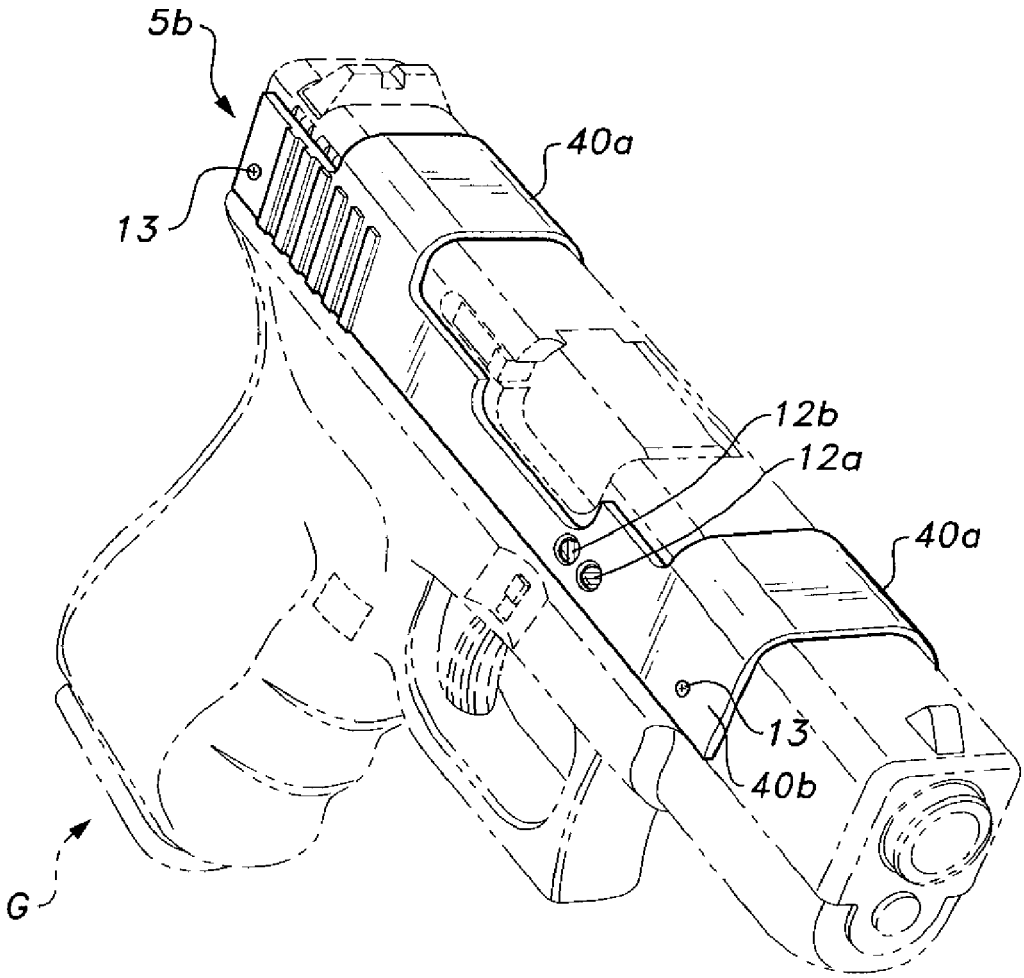
FIG. 5 is an environmental perspective view of the handgun identification light of FIG. 4, as seen from the right side of the gun.
Figure 6:
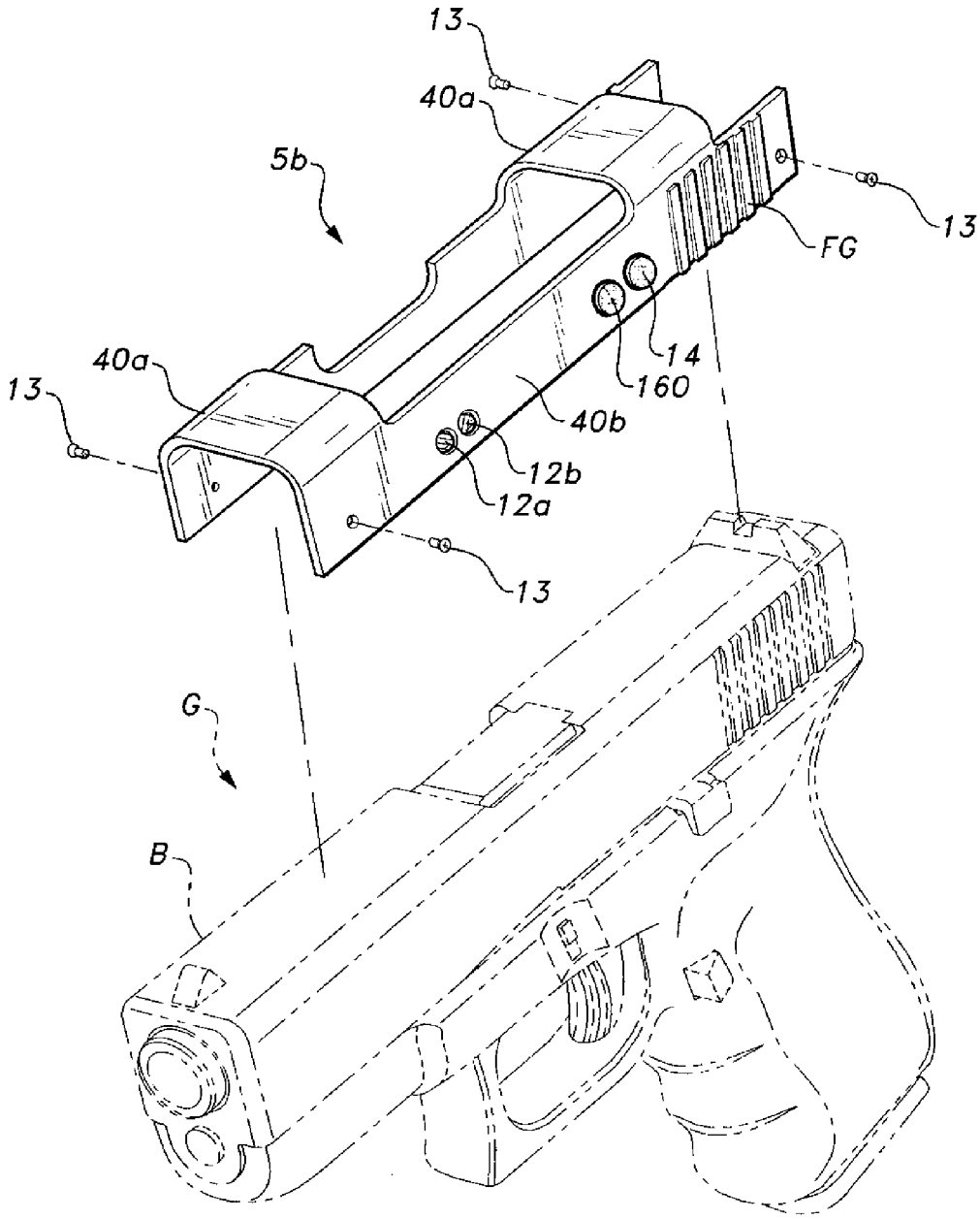
FIG. 6 is a perspective view of the handgun identification light of FIG. 4, shown with the handgun exploded from the handgun identification light.

As shown in FIGS. 4-6, an alternative embodiment of the handgun identification light 5*b*, again for use with an automatic or semi-automatic pistol G, has two longitudinally extending side members 40*b*, which are joined by laterally extending top crossmembers 40*a* to form a U-shaped, partially open-topped barrel clamp that mounts to the slide of the gun G from the top. The gap between the crossmembers 40*a* permits ejection of spent cartridges from the chamber when firing the gun G. Setscrews 13 along the lower portion of the side members 40*b* are adjustable to secure the side members 40*b* to the slide of the handgun G. The rear portion of the longitudinally extending side members 40*b* includes a vertical arrangement of finger grips FG to facilitate the user pulling the slide of the gun G for adjustment, fire preparation, and the like.

Disposed on both side members 40*b* are the LED lights 12*a* and 12*b*. A cutoff switch 14 and activation sensor 160 are disposed on one of the side members 40*b*. The battery power source BAT may be disposed inside the barrel cover portion of device 5*b*. The circuitry 990 interconnecting the cutoff circuit, battery and LED lights may also be connected to the activation sensor 160, which activates the LED lights 12*a* and 12*b* when the gun is either tilted into a fire-ready position, or, alternatively, when the gun is in motion outside of its holster.

Figure 7:
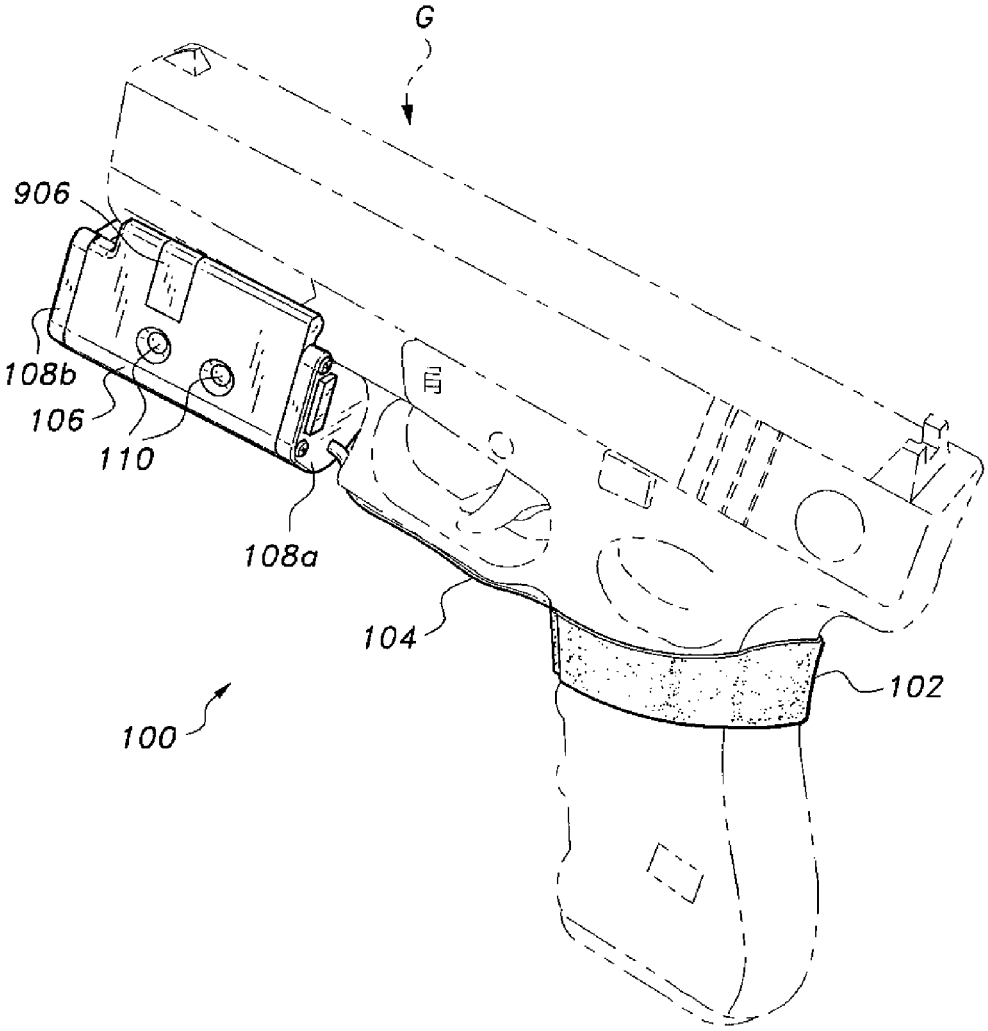
FIG. 7 is an environmental perspective view of a handgun equipped with a third embodiment of a handgun identification light according to the present invention, as seen from the left side of the gun.
Figure 8:
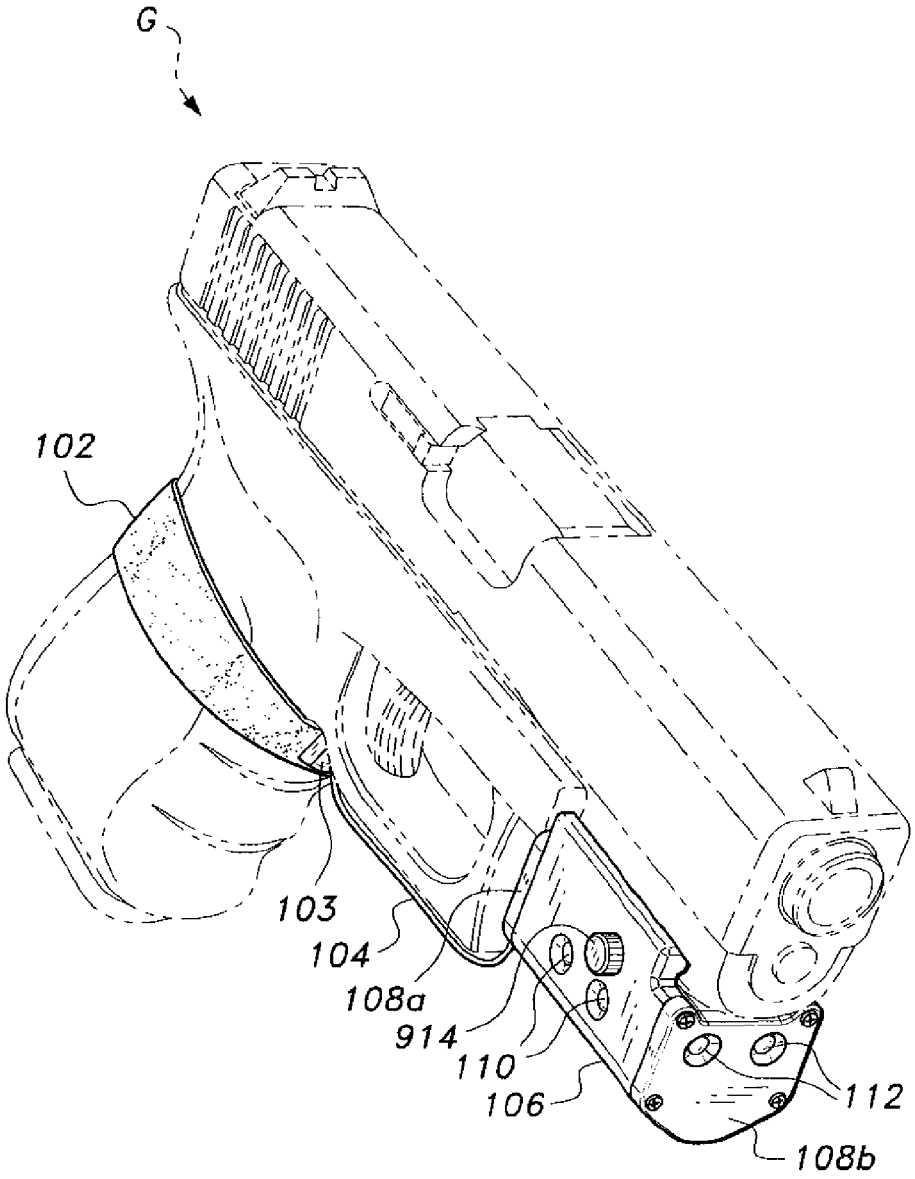
FIG. 8 is an environmental perspective view of the handgun identification light of FIG. 7, as seen from the right side of the gun.
Figure 9:
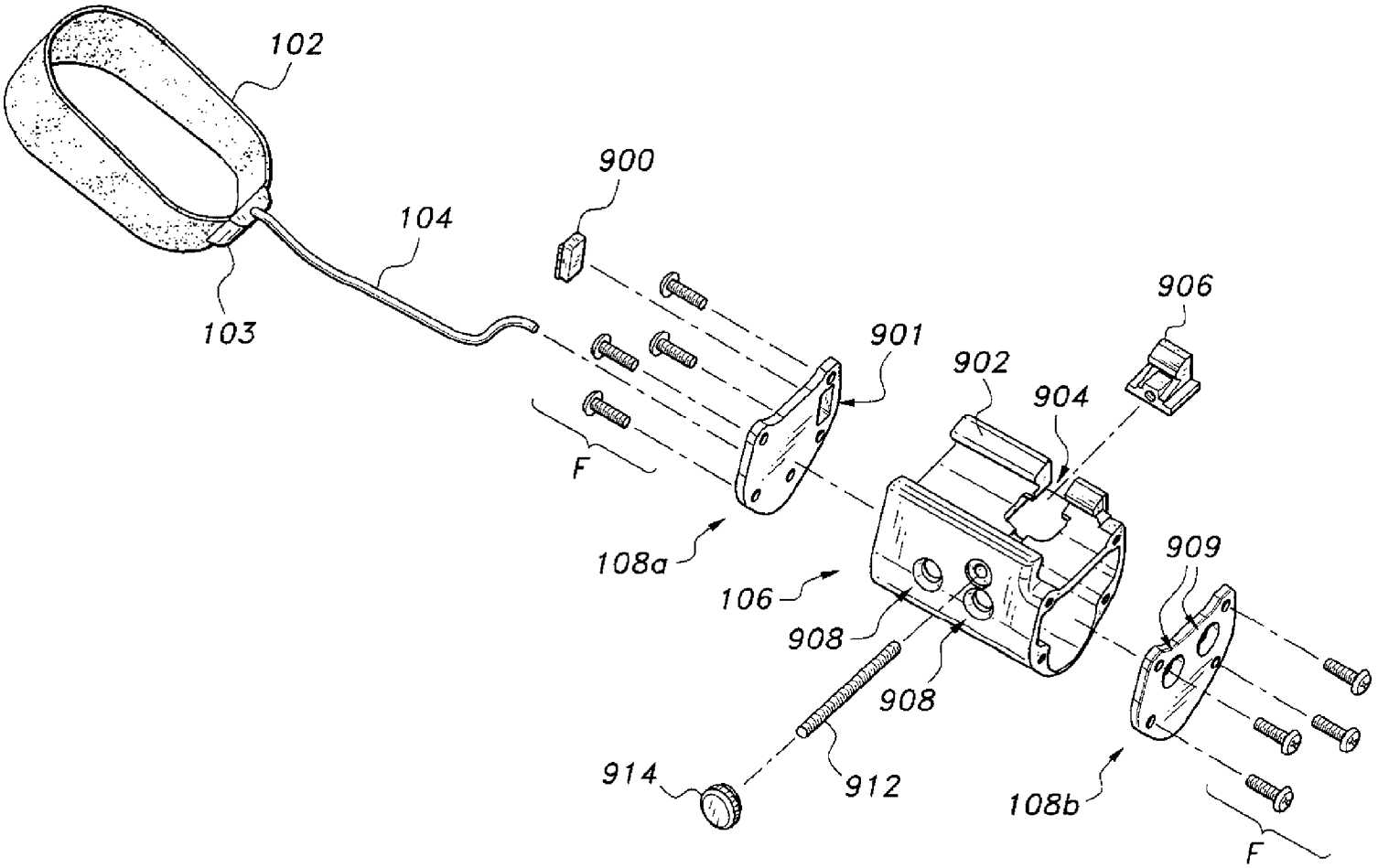
FIG. 9 is an exploded perspective view of the handgun identification light of FIG. 7.

Yet another exemplary embodiment of a handgun identification light, designated generally as 100 in the drawings, is shown in FIGS. 7-9. As shown in FIG. 7, the handgun identification light 100 has a switch or grip-sensitive actuator 103 attached to the grip of the handgun by a flexible, resilient band 102. The switch or actuator 103 has a cable 104 extending therefrom to a hollow slide body 106 and may connect to the S input of microprocessor-memory combination 940 in programmable control electronics 990 shown in FIG. 10. When the grip sensitive actuator 103 detects a grip, or alternatively, a momentary finger press, the flashing LED's on the handgun identification light 100 are energized to thereby alert any observer that a Law Enforcement Officer's weapon has been drawn. The hollow slide body 106 includes a rear end plate 108*a*. A plurality of light emitting diodes (LEDs) 110 are disposed along sides of the hollow slide body 106. The entire unit removably attaches to the firearm G. Additionally, FIG. 8 shows a front end plate 108*b* attached to the front portion of the hollow slide body 106. Additional LEDs 112 are mounted on the front end plate 108*b*, or are visible through openings in the front end plate 108*b*.

The exploded, perspective view of FIG. 9 most clearly shows the USB recess 901 disposed in the hollow slide body 106. A USB receptacle or port is capable of being mounted in or accessible through the USB recess 901 and is connectable to programming port input P of microprocessor 940, shown in FIG. 10. A USB cover 900 is designed to cover and protect the receptacle when the handgun identification light 100 is not being programmed via a USB cable attached to the receptacle.

An upper portion of hollow slide body 106 has a pair of chamfered edges 902 designed for a tight slide fit over a slide rail portion of the handgun G. A slide lock recess 904 in the slide body 106 accepts a slide lock 906 between a break in the chamfered edges 902. The slide lock 906 has a chamfered edge that also engages the slide rail of handgun G, and can be tightened onto the slide body 106 using a threaded stud 912 and its associated tightening knob 914 to securely thread the stud 912 into a threaded bore defined in the slide lock 906.

Figure 10:
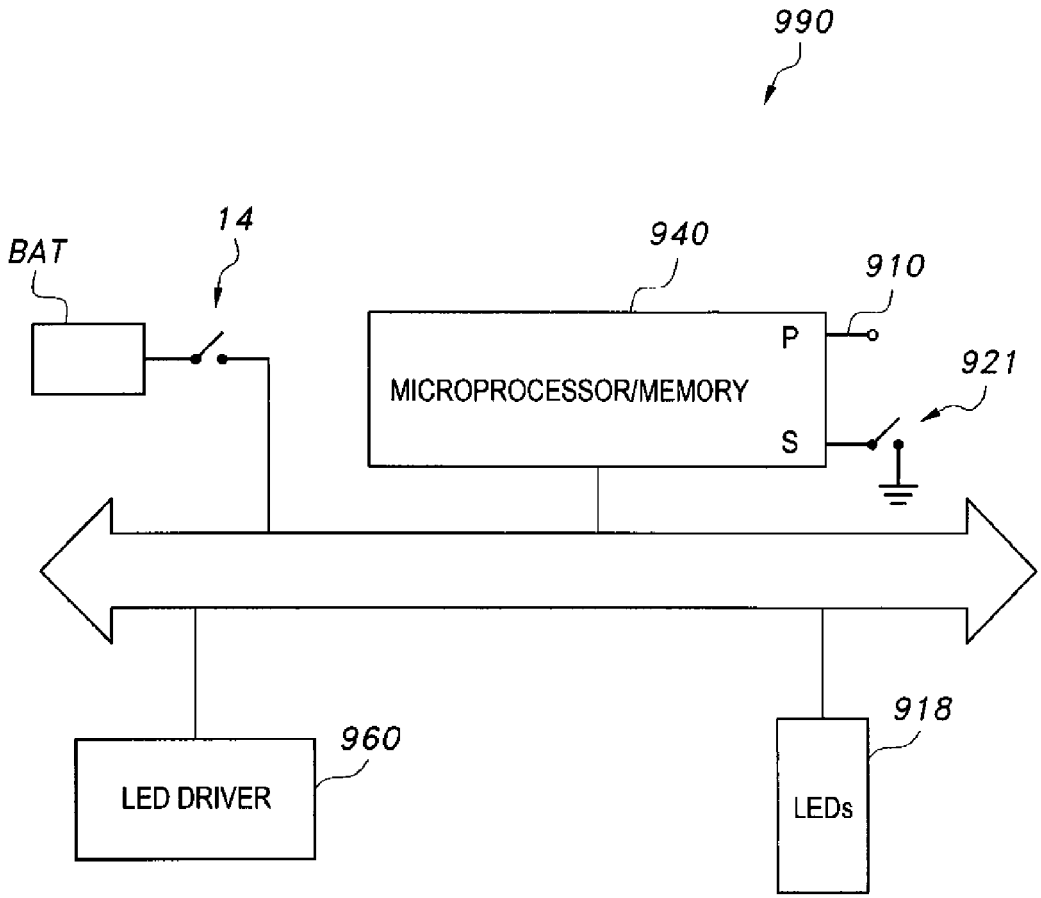
FIG. 10 is a block diagram of an exemplary electronic circuit of a handgun identification light according to the present invention.

FIG. 10 shows an exemplary electronic circuit 990 for the handgun identification light. The circuit 990 includes an LED driver circuit 960, and a power source BAT that can be housed inside the hollow slide body 106. It is contemplated that the circuit 990 may control the color, the intensity, and the flashing pattern of the side LEDs 110 and the front LEDs 112, which are disposed in side LED holes 908 and front LED holes 909, respectively. Threaded fasteners F secure the rear plate 108*a* and the front plate 108*b* to rear and front ends of the slide body 106, respectively.

It is to be understood that the present invention is not limited to the embodiments described above, but encompasses any and all embodiments within the scope of the following claims.

I claim:

1. A handgun identification light, comprising:

a member attachable to a handgun without interfering with firing operations of the handgun, wherein the attachable member comprises a U-shaped, partially open-top barrel clamp adapted for mounting to the slide of the handgun from the top and further comprises longitudinally extending side members having a rear portion and vertically arranged finger grips on the rear portion to facilitate the user pulling the slide of the gun;

an assembly of highly visible flashing lights disposed on the attachable member;

an electronic circuit for activating the flashing lights, the electronic circuit being disposed in the attachable member, the electronic circuit including a circuit for activating the assembly of flashing lights when the handgun is removed from a holster; and a cut-off switch disposed on the attachable member, the cut-off switch forming part of the electronic circuit and selectively de-activating the assembly of flashing lights when switched to a cut-off position by a user of the handgun.

2. The handgun identification light according to claim 1, wherein said electronic circuit is programmable in order to program a flash pattern of said flashing lights.

3. The handgun identification light according to claim 1, wherein said circuit for activating the flashing light comprises a pressure sensitive switch adapted for being disposed over a grip portion of the handgun.

4. The handgun identification light according to claim 1, wherein said circuit for activating the flashing lights comprises a tilt sensitive switch disposed on said member attachable to the handgun.

5. The handgun identification light according to claim 1, wherein said circuit for activating the flashing lights comprises a motion sensitive switch disposed on said member attachable to the handgun.

6. The handgun identification light according to claim 1, wherein said electronic circuit comprises a battery power source.

7. A handgun identification light, comprising:

an elongated member attachable to an automatic handgun without interfering with firing operations of an automatic handgun, the elongated member having a longitudinal axis, wherein the attachable member defines an open, channel sheath having side portions;

a plurality of highly visible flashing lights located on the side portions of the attachable member and disposed transverse to the longitudinal axis;

an electronic circuit for activating the flashing lights, the electronic circuit being disposed in the attachable member, the electronic circuit including a circuit for activating the assembly of flashing lights when the handgun is removed from a holster; and a cut-off switch disposed on the attachable member, the cut-off switch forming part of the electronic circuit and selectively de-activating the assembly of flashing lights when switched to a cut-off position by a user of the handgun.

8. The firearm identification light according to claim 7, wherein the side portions extend to an area below the slide of an automatic handgun.

9. The firearm identification light according to claim 7, wherein the attachable member comprises a U-shaped, partially open-top barrel clamp adapted for mounting to the slide of an automatic handgun from the top and further comprises longitudinally extending side members having a rear portion and vertically arranged finger grips on the rear portion to facilitate the user pulling the slide of the gun.

10. The handgun identification light according to claim 7, wherein said attachable member comprises:

a slotted elongate high impact resistant member fitted to a contour of the handgun; and a resilient, semi-rigid flexible grip sheath extending from a rear portion of the slotted elongate high impact resistant member.

11. The handgun identification light according to claim 7, wherein said attachable member comprises:

a band attachable to a grip portion of the handgun, the band having an activating switch mounted thereon;

an electronic cable extending from the switch; and a hollow slide body adapted for mounting to the slide rail of the handgun, the electronic circuit being housed in the hollow slide body and the electronic cable interconnecting the band-mounted switch and the electronic circuit, said highly visible flashing lights being disposed on the hollow slide body.

* * * * *